US005094764A

United States Patent [19]

Kuwamoto et al.

[11] Patent Number: 5,094,764

[45] Date of Patent: Mar. 10, 1992

[54] METHOD FOR SUPPLYING A LUBRICATING OIL COMPOSITION

[75] Inventors: Hiroshi Kuwamoto; Yoshihiro Sakaguchi, both of Fukuyama; Hiroyuki Nagamori; Yasuhiro Nakagawa, both of Wakayama, all of Japan

[73] Assignees: Kao Soap Co., Ltd.; Nippon Kokan Kabushiki Kaisha, both of Tokyo, Japan

[21] Appl. No.: 634,108

[22] Filed: Dec. 26, 1990

Related U.S. Application Data

[60] Division of Ser. No. 380,540, Jul. 17, 1989, Pat. No. 4,985,158, which is a division of Ser. No. 482,011, Apr. 4, 1983, Pat. No. 4,970,011, which is a continuation of Ser. No. 142,826, Apr. 22, 1980, abandoned.

[51] Int. Cl.[5] ..... C10M 173/00

[52] U.S. Cl. ..... 252/49.3; 252/49.5; 252/56 D

[58] Field of Search ..... 252/49.3, 49.5, 56 D

[56] References Cited

U.S. PATENT DOCUMENTS

| | | | |
|---|---|---|---|
| 3,462,249 | 8/1969 | Tunkel | 252/56 D |
| 3,507,790 | 4/1970 | Beerbower et al. | 252/49.5 |
| 3,589,923 | 6/1971 | Stein | 252/52 A |
| 4,160,370 | 7/1979 | Hacios | 252/49.5 |
| 4,240,916 | 12/1980 | Rossi | 252/56 D |

*Primary Examiner*—Jacqueline V. Howard

*Attorney, Agent, or Firm*—Oblon, Spivak, McClelland, Maier & Neustadt

[57] ABSTRACT

A lubricating oil composition containing as essential ingredients a lubricating oil component having a melting point of not higher than 100° C., and one or more water-soluble dispersants selected from the group consisting of anionic polymeric dispersants of a molecular weight of 250 to 25,000, and polyoxyethylene type surfactants of a molecular weight of 3,000 to 20,000 and an HLB value of at least 18, said lubricating oil component being present in a stably dispersed state in water, achieves excellent adhesion when supplied to a machined portion.

3 Claims, No Drawings

METHOD FOR SUPPLYING A LUBRICATING OIL COMPOSITION

This is a division of application Ser. No. 07/380,540, filed on July 17, 1989 now U.S. Pat. No. 4,985,158, which is a division of Ser. No. 06/482,011, filed on Apr. 4, 1983, now U.S. Pat. No. 4,970,011, which was a continuation of Ser. No. 06/142,826, filed on Apr. 22, 1980, now abandoned.

BACKGROUND OF THE INVENTION

1. Field of the Invention

The present invention relates to a novel lubricating oil composition and to a method for supplying the lubricating oil composition.

2. Description of the Prior Art

Among conventional rolling oils which are generally used as lubricants for cold rolling of steel slabs, plates or the like, there are animal- or plant-type oils and mineral-type oils. As a lubricating oil component, the former type oils contain triglyceride, while the latter type oils contain a petroleum hydrocarbon into which an oilness improver, extreme pressure agent, antioxidant, etc. are formulated. Such conventional oils are employed together with an emulsifier as 1-20% oil-in-water (O/W) type emulsions.

However, such emulsion-type lubricating oil agents encounter various drawbacks and are not satisfactory.

Many studies have been made on lubricating oil compositions to solve the drawbacks of the conventional lubricating oil compositions. As a result of these studies, it has been found that a composition comprising a liquid lubricating oil component, fatty acid or its glyceride, and wax such as slacks wax is favorable since it serves as a protective coating agent for the surfaces of stored metallic articles and effectively also any constituent, which was only in such emulsion, to float thereon (Japanese Patent Publication No. 42927/1973). Another finding is that a lubricating oil composition containing paraffin wax and an oxidation product of an α-olefin exhibits good lubricating properties and causes almost no oil stains (Japanese Patent Publication No. 7174/1978, and Japanese Laid-open Patent Applications Nos. 67906/1974 and 82707/1974). Notwithstanding these efforts, such lubricating oil compositions still remain unsatisfactory.

A rolling oil takes an important role in the lubrication of the arcuate contact area between a roll and a steel strip and prevents the roll and steel strip from being brought into direct contact with each other under high load conditions. In the cold rolling techniques, there has been a marked tendency toward high speed rolling to increase productivity as well as toward omission of a surface cleaning step such as electrolylic cleaning to simplify any treatment steps after rolling. Thus, a need continues to exist for the development of a rolling oil which can withstand high load and high speed rolling and which requires no cleaning step, and further research to this end is presently being conducted.

Although it is important to select any suitable lubricating oil component, oilness improver, extreme pressure agent, etc., by which a rolling oil is prepared, in order to improve the quality of the rolling oil, particular importance lies in controlling the nature of a system in which a lubricating oil composition is emulsified in water for actual use. In other words, any conventional rolling oil is supplied in the form of an aqueous emulsion for rolling lubrication operation. Even if there is no difference in the compositions of the lubricating oil components, the amount of the oil which adheres to the surfaces of a roll and a steel strip (i.e., the plated-out quantity) would vary depending on the stability of the emulsified particles. Therefore, the quantity of the rolling oil to be taken into the arcuate contact area between the roll and the steel strip would change from one lubricating oil composition to another and result in varied rolling lubrication characteristics.

Where a great deal of an oil is rolled into the arcuate contact area between a roll and a steel strip, lubrication would generally be improved on the surface of the strip, on which surface the size of the steel strip is being expanded by virtue of plastic deformation. This renders small the contact area between the roll and the strip and hence improves the rolling lubrication conditions.

Therefore, where a rolling oil is used in the form of an aqueous dispersion, it is necessary to prepare the dispersion system as unstably as possible to increase the plated-out quantity. On the other hand, where a rolling oil is formulated into an aqueous composition and where such aqueous composition is circulated, it is preferred that the aqueous dispersion system be stable and easy to handle.

In general, a lubricating oil agent is continuously circulated over a long period of time during which it is susceptible of being tainted by, besides scum and dirty oil, so-called "contaminants" such as fine metal powders, a lubricating oil for roll bearings, an anti-rusting oil applied after pickling and the like. When such contaminants mix into the rolling oil and adhere to the surfaces of a roll and a steel strip, they have adverse effect on the rolling lubrication characteristics and deteriorate the surface cleanliness of a steel plate obtained by the rolling operation. If the steel plate is subjected to an annealing step without any pretreatment, oil stains may occur on the surface of the steel plate due to the adherent oil or contaminants. Thus, it is desired that such contaminants not mix into the lubricating oil agent during the circulation of the agent but separate from the agent and float into the top layer of the agent or precipitate into the bottom layer for easy removal of the contaminants from the rolling oil.

As described above, a rolling oil has hithertofore been emulsified in water together with an emulsifier to form an aqueous emulsion. The stability of the emulsion (E.S.I.) is adjusted by controlling the content of the rolling oil and the HLB value (normally 8 to 14). In such emulsion-type rolling oil which is prepared by emulsifying a lubricating oil component in water, the plated-out quantity tends to be in inverse proportion to the E.S.I. If the stability of the emulsion is increased, the plated-out quantity relative to a steel plate becomes decreased, thereby rendering the lubrication insufficient. On the other hand, if the plated-out quantity is increased, the emulsion becomes unstable and creates various obstacles to circulated application of the rolling oil.

Moreover, the emulsion-type rolling oil involves scum or floating oil fractions due to polymerization or decomposition of the emulsion during its circulation. Lowering the concentration of the emulsion adversely affects its lubrication properties, thereby causing accidents such as burning or damage to expensive rolls, and further developing heat marks on rolled steel plates and spoiling the quality of the products. Furthermore, the lubricating oil agent per se is tainted by the absorption of the above-described scum, floating oil fractions, fine metal powders, lubricating oil for roll bearings, anti-rusting oil, etc. Such contaminants are taken into the emulsion by the action of the emulsifier, but it is difficult to separate and remove the contaminants. During the circulation of the rolling oil, the content of such contaminants becomes higher that it is impossible to avoid re-adhesion of the contaminants to the surface of a steel plate during rolling operation.

In view of the situation with the existing techniques, the present inventors have made extensive studies to surmount the above-noted drawbacks of the conventional rolling oils and have found that extremely good characteristics can be achieved by dispersing a lubricating oil component in water by using some specific water-soluble dispersants.

More particularly, where a lubricating oil component is an oil, fat or wax having a melting point in the range of 20° to 100° C., the lubricating oil component is stably dispersed in water in a solid state at a temperature not higher than its melting point. When supplied to a machined portion at a temperature of at least its melting point, the lubricating oil component becomes unstable and adheres to the machined portion, thereby exhibiting good lubrication action.

If a lubricating oil component is an oil or fat of a melting point lower than 20° C., the oil particles are dispersed in water in a relatively large particle size, as is different from the conventional emulsions. Accordingly, such lubricating oil component shows good plating-out properties on rolls and steel plates having surfaces of high energy during rolling operation. In addition, since agglomeration of the oil particles is inhibited by the action of the dispersant, the dispersion is kept stable. As compared with the conventional emulsions, less contaminants are liable to mix into the present dispersion. Even if mixed, the contaminants may be removed easily.

SUMMARY OF THE INVENTION

Therefore, it is one object of the present invention is to provide a lubricating oil composition whose lubricating oil component is present in a stably dispersed state in water and which achieve excellent adhesion properties when supplied to a machined portion under plastic working as well as repellant properties of preventing the absorption of contaminants such as metal powders which occur during the plastic working, a deteriorated oil, a tramp oil tainted by bearing oil, etc. and which can be recirculated.

Another object of this invention is to provide a method for supplying such lubricating oil composition to a machined portion.

The present invention provides a lubricating oil composition containing as essential ingredients a lubricating oil component having a melting point of not higher than 100° C., and one or more water-soluble dispersants selected from the group consisting of anionic polymeric dispersants of a molecular weight of 250 to 25,000,and polyoxyethylene type surfactants of a molecular weight of 3,000 to 20,000 and an HLB value of at least 18.

The lubricating oil compositions according to the present invention may be divided into the following two embodiments depending on the melting point of the lubricating oil component.

(1) a lubricating oil composition containing as essential ingredients a lubricating oil component containing 10 to 100% by weight of one substance or a mixture of at least two substances selected from the group consisting of an oil, fat and wax having a melting point of 20° to 100° C. as well as one or more water-soluble dispersants selected from the group consisting of anionic polymeric dispersants having a molecular weight of 250 to 25,000, and polyoxyethylene type surfactants having a molecular weight of 3,000 to 20,000 and an HLB value of at least 18; and (2) a lubricating oil composition containing as essential ingredients a lubricating oil component having a melting point lower than 20° C. and a viscosity of 5 to 300 centistokes (cst) at 20° C. as well as one or more water-soluble dispersants selected from the group consisting of anionic polymeric dispersants having a molecular weight of 250 to 25,000 and polyoxyethylene type surfactants having a molecular weight of 3,000 to 20,000 and an HLB value of at least 18.

Furthermore, the present invention provides a method for supplying a lubricating oil composition, comprising suspending in water in a solid state a lubricating oil component of a melting point in the range of 20° to 100° C. by using the water-soluble dispersant or dispersants described above at a temperature lower than the melting point of the lubricating oil component in such a manner that a dispersion is formed; and supplying the thus prepared dispersion at a temperature of at least the melting point of the lubricating oil component to a machined portion under plastic working, or supplying the dispersion to a machined portion which has been heated up to a temperature of at least the melting point of the lubricating oil component.

DETAILED DESCRIPTION OF THE PREFERRED EMBODIMENTS

Among lubricating oil components useful in a lubricating oil composition according to the present invention, there are the following substances:

As an oil, fat or wax having a melting point of 20° to 100° C., there is an ordinary animal or plant oil having a melting point of at least 20° C. such as palm oil, tallow, lard or sheep oil; a natural wax such as bees wax, carnauba wax, montan wax and microcrystalline wax; and a synthetic wax such as polyethylene wax, ketone wax and ester wax. The oil, fat or wax may be used solely or jointly. It is preferred that such oil, fat or wax be present in an amount of 10 to 100% by weight of the lubricating oil component. As other component for the lubricating oil component in the lubricating oil composition (1), use is made, for example, of a mineral oil such as spindle oil, machine oil, turbine oil or cylinder oil; and any other known oil which can be employed as a lubricant oil. Such other component may be employed in the range of at most 90% by weight of the lubricating oil component, but it is preferred that the above-described oil, fat or wax be contained in a larger amount than such other component.

As a lubricating oil component having a melting point lower than 20° C., there is a substance or a mixture of at least two substances selected from the group consisting of a mineral oil such as spindle oil, machine oil, turbine oil or cylinder oil; an animal or plant oil such as whale oil, coconut oil, rape seed oil, castor oil, rice bran oil or palm oil; an ester of an animal or plant fatty acid such as an ester of a fatty acid derived from tallow, coconut oil, palm oil and castor oil, and a $C_{1-18}$ aliphatic primary alcohol, ethylene glycol, neopentyl glycol or pentaerythritol; a $C_{10-12}$ fatty acid or olefinic polymers; an ester-type or ether-type polymer having an average molecular weight of 1,000 to 20,000, for example, an oilness agent such as a high molecular polymer of methylmethacrylate, polybutene, polyalkylene glycol or dimer acid, said oilness agent having a melting point lower than 20° C. and a viscosity of 5 to 300 cst at 20° C. In the lubricating oil composition (2), if the viscosity of the lubricating oil component is 5 cst or lower at 20° C., the amount of the oil to be taken fluid-dynamically into the arcuate contact area between a roll and a steel strip from the oil plated out onto the roll and steel strip decreases, thereby deteriorating the rolling lubrication characteristics. On the other hand, if the viscosity of the lubricate oil component is 300 cst or higher at 20° C., the lubricating oil component hardly evaporates when the steel plate is annealed after its rolling operation without removing the lubricating oil component and he renders poor the cleanliness of the surface of the steel plate. This may result in the formation of oil stains. Accordingly, it is not preferable to employ a lubricating oil component whose viscosity does not fall within the range of 5 to 300 cst at 20° C.

Among water-soluble dispersants useful in the present invention, there are the following substances:

(1) anionic polymeric dispersants having a molecular weight of 250 to 25,000:

(a) salts of olefin-maleic acid copolymers, for example, an alkali metal, ammonium or amine salt of a copolymer of maleic acid and an olefin containing 2 to 20 carbon atoms, said salt having an average molecular weight of 250 to 25,000;

(b) salts of acrylic acid or methacrylic acid-maleic acid copolymers, for example, an alkali metal, ammonium or amine salt of one of the copolymers, said salt having an average molecular weight of 500 to 25,000;

(c) salts of acrylic acid or metacrylic acid homopolymers and salts of acrylic acid-methacrylic acid copolymers, for example, an alkali metal, ammonium or amine salt of one of the homopolymers or copolymers, said salt having an average molecular weight of 500 to 25,000; and (d) salts of condensation products of aromatic sulfonic acids and formaldehyde, for example, an alkali metal, ammonium or amine salt of a condensation product of one or more of naphthalene sulfonic acid, creosote sulfonic acid, cresol sulfonic acid, alkylnaphthalene sulfonic acid containing an alkyl group of 1 to 4 carbon atoms or lignin sulfonic acid and formaldehyde (condensation degree: 2 to 50).

Among such anionic polymeric dispersants, salts (a) to (c) having a molecular weight of 2,000 to 10,000 are particularly preferred.

(2) polyoxyethylene type surfactants having a molecular weight of 3,000 to 20,000 and an HLB value of at least 18:

for example, polyoxyethylene alkylethers, polyoxyethylene alkylphenylethers, polyoxyethylene alkylamines, polyoxyethylene fatty acid esters, polyoxyethylene alkylsulfates, polyoxyethylene alkylphosphates, salts of the carboxymethylated compounds of polyoxyethylene alkylethers, polyoxyethylene sorbitan fatty acid esters and oxyethylene-oxypropylene copolymers. As salts there are alkali metal, ammonium and amine salts. The alkyl groups each contain 2 to 20 carbon atoms, and the mole ratio of each addition to ethylene oxide is selected to give an HLB value of at least 18.

Among such polyoxyethylene type surfactants, polyoxyethylene solbitan fatty acid esters, polyoxyethylene fatty acid esters, polyoxyethylene sorbitol fatty acid esters and polyoxyethylene alkyl amines are particularly preferred.

These water-soluble dispersants may be used solely or jointly and are preferably added to the lubricating oil component in an amount of 0.5 to 20% by weight of the lubricating oil component.

Where it becomes necessary, various known additives may be made to the lubricating oil composition according to this invention. These additives can be selected, for example, from an antirusting agent, an oilness improver, an extreme pressure agent such as a phosphorus-containing compound, for instance, an ester of an organic phosphoric acid or a zinc salt of dialkylthiophophoric acid, an antioxidant such as an aromatic amine, etc.

The lubricating oil composition according to this invention may be in the form of either a mere mixture of the above-described lubricating oil component and at least one water-soluble dispersant or a concentrated solution having a water content of up to about 80% at the time of application. When actually used, it may be diluted with water.

The lubricating oil composition (1) according to the present invention is dispersed in water in the form of solid particles by the action of the water-soluble dispersant when it is suspended in the water at a temperature of or lower than the melting point of the oil, fat or wax contained in the lubricating oil component, and forms a stable emulsion. On the other hand, when the temperature is raised to at least the melting point of the oil, fat or wax, the solid particles become liquid particles and turn into a so-called O/W type emulsion. The present invention makes use of such a dispersant that keeps stable a system containing solid particles dispersed in water but is not so much effective as to stabilize an O/W type emulsion. Therefore, the emulsion can be broken, and adhesion of the oil component to a machined portion is increased.

When the lubricating oil composition according to this invention is used, for example, as a rolling oil, it remains stable at a temperature lower than the melting point of the oil, fat or wax. However, when it is supplied at a temperature of at least the melting point of the oil, fat or wax to the contact area between a roll and a steel strip, its dispersion can be broken in that a great deal of the rolling oil adheres to the roll and steel strip, thereby presenting excellent lubrication action. Furthermore, if the recovered rolling oil is cooled to a temperature of or lower than the melting point of the oil, it turns into a stable dispersion to be rendered suitable for recirculation.

The lubricating oil composition according to the present invention can be stored at low temperatures and adapted for circulated application. Therefore, it can save energy and improves the workshop environment. Because of storage in the form of a dispersion, the oil composition does not develop any coagulation of contaminants such as scum, iron powders and dispersed particles, and facilitates easy removal of such contaminants. Furthermore, since the dispersion state becomes unstable at the time of lubrication at temperatures of or higher than the melting point of the lubricating oil component, the oil and water are easy to separate so that the waste water can be easily treated.

A method for supplying the lubricating oil composition (1) to a machined portion will be explained below with respect to supplying, for example, a rolling oil to a roll and a steel strip.

First of all, the lubricating oil composition (1) which has been suspended in water in such a manner that it has a solid content of 0.1 to 40% by weight, more preferably 1 to 20% by weight at a temperature below the melting point of the oil, fat or wax contained as the lubricating oil component while mechanically agitating the dispersion. Then, the dispersion is preheated to a temperature above the melting point by a heat exchanger or like equipment to render the dispersion state unstable, and the thus preheated dispersion is supplied to a machined portion. Alternatively, the dispersion is directly supplied to a machined portion which has been heated by the friction energy and working heat occurring between the roll and steel strip to render the dispersion state unstable and allow the lubricating oil component to adhere to the machine portion. After lubrication, the dispersion is recovered and cooled to a temperature below the melting point of the lubricating oil component through natural cooling or by a heat exchanger or like equipment prior to the recirculation thereof.

On the other hand, the lubricating oil composition (2) does not have such a low surface tension as the conventional rolling oil employing an emulsifier (20 to 35 dyne/cm). Thus, natural emulsification or emulsified dispersion by simple agitation cannot be expected to occur. However, owing to the strong protective colloidal dispersing force of the water-soluble dispersant, the lubricating oil component can be finely divided into particles by predetermined mechanical agitation operation and remains at a stable dispersion. If the particles coagulate together although such coagulation does not occur so often and hardly permits the particles to form an oil layer, it is easy to break such coagulated particles and to evenly disperse them in water by slight agitation. The thus formed particles of the lubricating oil component have a greater diameter than the conventional emulsion-type oil. Consequently, they exhibit good adhesion to the roll surfaces and to the steel slab having high energy during the rolling operation and impart excellent lubricating characteristics for cold rolling operation.

Due to the function of the water-soluble dispersant, the dispersed particles of the lubricating oil component do not cause coagulation or agglomeration with contaminants such as fine metal powders and tramp oil, nor do they absorb such contaminants as is customary with the conventional emulsiontype oil. Therefore, the lubricating oil component is free from contamination.

The dispersed particles of the lubricating oil component have a large diameter and, upon allowing the dispersion to stand, tend to float up into the top layer to form a creamy layer, which can be easily separated from the water layer, thereby facilitating the treatment of the waste water.

The present invention is described further in detail in conjunction with the following preferred embodiments.

EXAMPLE 1: ROLLING TEST

With respect to the lubricating oil compositions shown in Table 1, the rolling test was conducted using the method described below. The test results are shown in Table 2.

TABLE 1

| No. | Components other than water | Percentage components (wt. %) | Type of hydrophilic dispersant |
|---|---|---|---|
| Present invention | | | |
| 1 | tallow[1)] | 97 | hydrophilic dispersant (A): |
| | hydrophilic dispersant (A) | 3 | sodium salt of a copolymer of maleic acid and 1-octene, having an average molecular weight (M.W.) of 3,000 |
| 2 | palm oil[2)] | 95 | hydrophilic dispersant (B): |
| | hydrophilic dispersant (B) | 5 | triethyanol amine salt of a copolymer of acrylic acid and maleic acid having M.W. of 5,000 |
| 3 | tallow | 50 | hydrophilic dispersant (C): |
| | mineral oil (spindle oil) | 46.5 | water soluble surfactant consisting of polyoxyethylen fatty acid ester having M.W. of 4,500 and HLB of 19 |
| | antioxidant | 0.5 | |
| | hydrophilic dispersant (C) | 3 | |
| 4 | tallow | 92.5 | Same as in No. 2 |
| | fatty acid of head | 5. | |
| | antioxidant | 0.5 | |
| | hydrophilic dispersant (B) | 2 | |
| 5 | palm oil | 5 | hydrophilic dispersant (D): |
| | completely hydrogenated head[3)] | 5 | water soluble surfactant consisting of polyoxyethylene sorbitol fatty acid ester having M.W. of 7,500 and HLB of 18 |
| | mineral oil (spindle oil) | 71.5 | |
| | stearic acid | 3 | |
| | antioxidant | 0.5 | |
| | hydrophilic dispersant (D) | 15 | |
| 6 | tallow | 35 | hydrophilic dispersant (E): |
| | microcrystalline wax[4)] | 60 | water soluble surfactant consisting of polyoxyethylene alkylamine having M.W. of 3,100 and HLB of 18 |
| | dimer acid | 2 | |
| | antioxidant | 0.5 | |
| | hydrophilic surfactant (E) | 2.5 | |
| 7 | palm oil | 50 | hydrophilic dispersant (C): |
| | kent wax[5)] (distearyl ketone) | 40.5 | same as in No. 3 |
| | fatty acid of head | 7 | hydrophilic dispersant (F): the ammonium salt of the copolymer of chemically equivalent amounts of acrylic acid and methacrylic acid having M.W. of 700 |
| | antioxidant | 0.5 | |
| | hydrophilic dispersant (C) | 1.5 | |
| | hydrophilic dispersant (F) | 0.5 | |
| 8 | tallow | 40 | hydrophilic dispersant (A): |
| | montan wax[6)] | 10 | same as in No. 1 |
| | hydrogenated caster oil[7)] | 10 | hydrophilic dispersant (D): same as in No. 5 |
| | mineral oil | 33.5 | |
| | oleic acid | 5 | |
| | antioxidant | 0.5 | |
| | hydrophilic dispersant (A) | 0.5 | |
| | hydrophilic dispersant (D) | 0.5 | |
| Control | | | |
| (1) | tallow | 99.7 | hydrophilic dispersant (A): |
| | hydrophilic dispersant (A) | 0.3 | same as in No. 1 |
| (2) | tallow | 69.5 | hydrophilic dispersant (C): |
| | fatty acid of head | 5 | same as in No. 3 |
| | antioxidant | 0.5 | |
| | hydrophilic dispersant (C) | 25 | |
| (3) | tallow | 95 | hydrophilic dispersant (G): |
| | hydrophilic dispersant (G) | 5 | the sodium salt of a copolymer of maleic acid |

TABLE 1-continued

| No. | Components other than water | Percentage components (wt. %) | Type of hydrophilic dispersant |
|---|---|---|---|
| | | | and isobutylene, having M.W. of 230 |
| (4) | tallow | 91.5 | emulsifier: nonionic |
| | fatty acid | 5 | surfactant consisting of |
| | of head | | polyoxyethylene nonyl- |
| | antioxidant | 0.5 | phynyl ether having HLB |
| | emulsifier | 3 | of 11.5 and M.W. of 564 |
| (5) | commercially available rolling oil made of tallow | | |

Remarks:
1)melting point: 37° C., A.V. = 11, S.V. = 196
2)melting point: 32° C., A.V. = 7, S.V. = 198
3)melting point: 60° C., A.V. = 10, S.V. = 195
4)melting point: 56° C.
5)melting point: 82° C.
6)melting point: 73° C.
7)melting point: 82° C.

(A) Rolling Test Method

Rolling mill: 100 mm in diameter × 150 mm wide, two-high rolling mill equipped with rolls made of forged steel.

Strips to be rolled: SPCC, S, D, (JIS, G3141) thickness: 1 mm width: 30 mm.

Rolling speed: 1000 m/min.

(H) Supply Method of Rolling Oil

Each lubricating oil composition was mixed with water in a predetermined concentration. The mixture was then subjected to forced agitation while maintaining the same at a temperature above the melting point of one of or a mixture of at least two of the oil, fat and wax contained in the lubricating oil composition. Thereafter, the mixture was cooled to a predetermined temperature below the melting point of the mixture while forcedly agitating the same to prepare a dispersion. However, in the case of the emulsion-type rolling oils which were selected as controls, the dispersions were prepared at the same temperature and their respective spray temperatures. Upon spraying the thus prepared dispersions to rolls and strips, the spray temperature was adjusted by means of a heat exchanger disposed adjacent to the intake of a gear pump. Each dispersion was sprayed at a rate of 3.0 /min. (under a pressure of 2.5 kg/cm$^2$).

Under the above conditions, the load was measured at the time of rolling with a reduction percentage of 50% and the load per unit width was then calculated.

The results are shown in Table 2.

TABLE 2

| | Lubricating oil composition No. | Adjustment temp. (°C.) of dispersion | Spray temp. (°C.) | Rolling load per unit width (reduction percentage: 50%) (kg/mm) |
|---|---|---|---|---|
| Present invention | 3 | 25 | 50 | 338 |
| | 4 | 30 | 60 | 315 |
| | 6 | 40 | 60 | 322 |
| | 7 | 40 | 65 | 319 |
| | 8 | 30 | 65 | 317 |
| control | (4) | 60 | 60 | 353 |
| | (5) | 60 | 60 | 341 |

As seen from the results shown in Table 2, the compositions of the present invention when used as rolling oils exhibit excellent rolling lubrication performance compared with the rolling oils which are each prepared by employing as an oil base the conventional oil or fat and emulsifying the same with an emulsifier as is clear from Controls (4) and (5). Thus, it has been found that the preparation method of a dispersion utilizing a water-soluble dispersant and the supplying method thereof are very effective to improve the lubrication performance of a rolling oil.

EXAMPLE 2: STABILITY TEST OF DISPERSION AND OIL ADHESION TEST (a) Stability Test of Dispersion Each lubricating oil composition shown in Table 1 was mixed with water in a predetermined concentration. The mixture was heated to a temperature above the melting point of one or a mixture of at least two of the oil, fat and wax contained in the lubricating oil composition and then agitated by a homomixer for 5 minutes at 5,000 rpm. Subsequently, the mixture was heated or cooled to a predetermined temperature within 5 minutes at the same agitation speed. Thereafter, the mixture was further agitated at a predetermined temperature at 500 rpm for one hour. The state of the mixture was observed with the naked eye, and the average particle diameter was measured by means of a Coulter counter.

The observations and measurements were classified into the following three ratings:

o : evenly dispersed phase; scarcely separated, floating substances observed in the top layer (average particle diameter: less than 10 μ)

Δ: evenly dispersed phase; slightly separated, floating substances observed in the top layer (average particle diameter: 10–16 μ)

x : separated; oil phases or solid coagular occurred (average particle diameter: over 16 μ)

(b) Oil Adhesion Test

Each lubricating oil composition was mixed with water in a predetermined concentration. The mixture was heated to a temperature of at least the milting point of one of or a mixture of at least two of the oil, fat and wax contained in the lubricating oil composition and agitated by a homomixer for 5 minutes at 5000 rpm. Thereafter, the mixture was cooled to a temperature of the melting point thereof within 5 minutes at the same agitation speed to prepare a dispersion. However, in the case of each emulsion-type rolling oil which was tested as a control, the dispersion was prepared at the same temperature as the spraying temperature.

The adhesion test was conducted by spraying onto a sample piece for 2 seconds (pressure: 1 atom; sprayed quantity: 1 (/min.) each dispersion which was preheated to a predetermined temperature by a heat exchanger located in adjacent relation to the intake of a gear pump, allowing the thus sprayed sample piece to dry, and then measuring the quantity of the oil which adhered to the sample piece by the weight method. The sample pieces used in the test were of the same type as employed in the rolling test and were 50 mm wide × 100 mm long. Each sample piece was in the range of 4.0 to 5.0 μ in its surface roughness and was deoiled with a solvent prior to the test.

The results are shown in Table 3.

TABLE 3

| | Sample No. | Lubricating oil composition No. (Table 1) | Melting point* (°C.) | Concentration of dispersion (wt. %) | Grade of stability of dispersion grade [temp. °C.] (average particle diameter μ) | | Spray temp. (°C.) | Adhesion quantity (g/m²) |
|---|---|---|---|---|---|---|---|---|
| This Invention | (i) | 1 | 37 | 5 | o[30](6.2) | x[60](18.3) | 60 | 1.9 |
| | (ii) | " | " | " | o[30](6.2) | x[60](18.3) | 30 | 1.2 |
| | (iii) | " | " | 1 | o[30](6.5) | x[60](19.5) | 60 | 0.8 |
| | (iv) | 2 | 32 | 5 | o[25](7.0) | x[50](20<) | 50 | 2.8 |
| | (v) | 2 | " | 25 | o[25](7.7) | x[50](19.5) | 50 | 9.7 |
| | (vi) | 3 | 37 | 5 | o[25](8.7) | x[50](17.5) | 50 | 1.6 |
| | (vii) | 4 | " | " | o[30](6.7) | x[60](20<) | 60 | 2.1 |
| | (viii) | 5 | 45-50 | " | o[25](8.0) | x[55](17.0) | 55 | 1.5 |
| | (ix) | 6 | 47-52 | " | o[40](8.3) | x[60](20<) | 60 | 3.1 |
| | (x) | 7 | 55-60 | 3 | o[40](7.5) | x[65](20<) | 65 | 2.9 |
| | (xi) | 8 | 57-62 | 5 | o[30](9.0) | x[65](20<) | 65 | 4.7 |
| Control | (xii) | (1) | 37 | 5 | x[30](20<) | x[65](20<) | — | — |
| | (xiii) | (2) | " | " | o[30](3.0) | o[60](9.5) | 60 | 0.7 |
| | (xiv) | (3) | " | " | x[30](20<) | x[60](20<) | — | — |
| | (xv) | (4) | " | " | x[30](17.2) | o[60](5.7) | 60 | 0.5 |
| | (xvi) | (5) | " | " | x[30](20<) | o[60](9.1) | 60 | 0.7 |

*the melting point of one of or a mixture of at least two of the oil, fat and wax contained in the lubricating oil compositions As apparent from Table 3, the lubricating oil compositions of the present invention are stable in the form of a dispersion at temperatures below their respective melting points of one of or a mixture of at least two of the oil, fat and wax, and exhibit large adhesion quantities and excellent lubrication performance under the coating conditions above their respective melting points. On the other hand, Controls (1) to (5) are not satisfactory in terms of either the stability or the lubrication performance or both and have been found to be inferior to the compositions according to the present invention.

EXAMPLE 3: CIRCULATION TEST OF DISPERSION

Each lubricating oil composition was mixed with water into a 5% by weight aqueous solution. The solution was heated to a liquid temperature in the range of 50° to 65° C. and subjected to forced agitation. Under the same agitation conditions, it was cooled to a temperature of 25° C., 30° C. or 40° C. to prepare a dispersion (the amount of dispersion: 20 l in a tank of a capacity of 30 l). The thus prepared dispersion was heated in the range of 50° to 65° C. by means of a heat exchanger arranged immediately adjacent to the intake of a gear pump and sprayed through a spray nozzle onto an iron plate which had been heated to 150° C. (pressure: 2.5 atms; oil supply: 3l/min.). The recovered dispersion was cooled to 30° C. by causing it to continuously pass through a heat exchanger while forcedly agitating the same in an auxiliary tank (of a capacity of 2 l) and then returned to a reservoir which was in communication with the gear pump. This operation was continuously repeated for 48 hours. Then, the oil fraction other than the floating top layer in the dispersion was extracted and weighed to see the oil loss in terms of the percentage with respect to the initially charged oil quantity. In this circulation test, finely divided iron powders were placed at the bottom of a receptacle for receiving the sprayed dispersion in an amount of 0.1% by weight of the total weight of the dispersion used. In the case of each emulsion-type oil composition which was tested as a control, the emulsion was circulated at 60° C. which was identical to the spraying temperature because the emulsion was unstable at 30° C.

The results are shown in Table 4.

TABLE 4

| | Lubricating oil composition No. | Preparation temperature of dispersion (°C.) | Spraying temp. (°C.) | Concentration decrease (based on initially formulated oil) (%) |
|---|---|---|---|---|
| This Invention | 3 | 25 | 50 | 21 |
| | 4 | 30 | 60 | 34 |
| | 5 | 25 | 55 | 15 |
| | 6 | 40 | 60 | 28 |
| | 7 | 40 | 65 | 24 |
| | 8 | 30 | 65 | 39 |
| Control | (4) | 60 | 60 | 62 |
| | (5) | 60 | 60 | 67 |

As apparent from Table 4, the circulation stability performance of the compositions according to this invention which are applied by the spray coating method of the invention has been found to be superior to that of the control composition (4) or (5).

EXAMPLE 4: WASTE WATER TREATMENT TEST

To a sample solution (1,000 m) was added 3 g of alumina sulfate at a temperature above the melting point of one of or a mixture of at least two of the oil, fat and was prepared in accordance with the same method as in the oil adhesion test. The mixture was stirred for two minutes, and then its pH was adjusted to 7 by addition of calcium hydroxide. After being agitated for 10 minutes, the resulting mixture was allowed to stand for 30 minutes. The subnatant liquid was then collected, and its COD was measured by the potassium permanganate method.

The results are shown in Table 5.

TABLE 5

| | Sample No. | Analysis method COD (potassium permanganate method) |
|---|---|---|
| This Invention | (i) | 37 |
| | (iv) | 41 |
| | (vi) | 110 |
| | (viii) | 124 |
| | (ix) | 121 |
| | (x) | 72 |
| Control | (xv) | 320 |

TABLE 5-continued

| Sample No. | Analysis method COD (potassium permanganate method) |
|---|---|
| (xvi) | 263 |

As apparent from the results shown in Table 5, the composition according to the present invention are generally superior in terms of the easy waste water treatment as compared with the emulsion-type dispersions represented by the control compositions (xv) and (xvi).

EXAMPLE 5: ROLLING TEST

With respect to the lubricating oil compositions shown in Table 6, the rolling test was conducted in accordance with the following method. The test results are shown in Table 7.

TABLE 6

| | | Lubricating oil composition | Composition (weight %) | Viscosity of lubricating oil component (cst at 40° C.) |
|---|---|---|---|---|
| This invention | 9 | lubricating oil components | | 15–18 |
| | | mineral oil (spindle oil) | 82 | |
| | | octyl ester of stearic acid | 10 | |
| | | oleic acid | 3 | |
| | | phosphoric acid ester type extreme pressure agent | 2 | |
| | | antioxidant | 1 | |
| | | hydrophilic dispersant (H) | 2 | |
| | 10 | lubrication oil components | | 40–43 |
| | | mineral oil (turbine oil free of any additives) | 51 | |
| | | methyl ester of stearic acid | 40 | |
| | | fatty acid of head | 3 | |
| | | phosphoric acid ester type extreme pressure agent | 2 | |
| | | antioxidant | 1 | |
| | | hydrophilic dispersant (I) | 3 | |
| | 11 | lubricating oil components | | 100–110 |
| | | mineral oil (cylinder oil) | 69 | |
| | | butyl ester of fatty acid of head | 15 | |
| | | oleic acid | 3 | |
| | | phosphoric acid ester type extreme pressure agent | 2 | |
| | | antioxidant | 1 | |
| | | hydrophilic dispersant (J) | 10 | |
| | 12 | lubricating oil components | | 30–33 |
| | | octyl ester of farry acid of head | 81 | |
| | | oleic acid | 3 | |
| | | polybutene | 10 | |
| | | phosphoric acid ester type extreme pressure agent antioxidant | 2 | |
| | | hydrophilic dispersant (K) | 3 | |
| | 13 | lubricating oil components | | 70–73 |
| | | mineral oil (turbine oil free of any additives) | 88 | |
| | | head | 5 | |
| | | dimer acid | 5 | |
| | | antioxidant | 1 | |
| | | hydrophilic dispersant (J) | 0.5 | |
| | | hydrophilic dispersant (L) | 0.5 | |
| Control | (6) | lubricating oil components | | 15–18 |
| | | mineral oil (spindle oil) | 80 | |
| | | octyl ester of stearic acid | 10 | |
| | | oleic acid | 3 | |
| | | phosphoric acid ester type extreme pressure agent | 2 | |
| | | antioxidant | 1 | |
| | | emulsifier | 4 | |
| | (7) | commercially available mineral oil type rolling oil | | |
| | (8) | lubricating oil components | | 100–101 |
| | | mineral oil (cylinder oil) | 78.7 | |
| | | butyl ester of fatty acid of head | 15 | |
| | | oleic acid | 3 | |
| | | phosphoric acid ester type extreme pressure agent | 2 | |
| | | antioxidant | 1 | |
| | | hydrophilic dispersant (J) | 0.3 | |
| | (9) | lubricating oil components | | 70–73 |
| | | mineral oil (additive-free turbine oil) | 64 | |
| | | head | 5 | |
| | | dimer acid | 5 | |
| | | antioxidant | 1 | |
| | | hydrophilic dispersant (H) | 25 | |
| | (10) | lubricating oil components | | 15–18 |
| | | octyl ester of farry acid of head | 79 | |
| | | oleic acid | 3 | |
| | | polybutene | 10 | |
| | | phosphoric acid ester type extreme pressure agent | 2 | |
| | | antioxidant | 1 | |
| | | hydrophilic dispersant (M) | 5 | |

Remarks: In the above table, the following hydrophilic dispersants and emulsifier are used:

hydrophilic dispersant(H): sodium salt of a copolymer of maleic acid and isobutylene having an average molecular weight ($\overline{M}$./ ) of 3,500 hydrophilic dispersant(I): triethanol amine salt of a copolymer of equivalent amounts of acrylic acid and methacrylic acid having M.W. of 6,000

(J): water-soluble surfactant consisting of polyoxyethylenefatty acid ester having $\overline{M}$./ of 4,500 and HLB of 19

(K): water-soluble surfactant consisting of polyoxyethylene alkyl amine having $\overline{M}$./ of 3,900 and HLB of 19.5

(L): sodium salt of a copolymer of acrylic acid and maleic acid having $\overline{M}$./ of 1,500

(M): sodium salt of a copolymer of maleic acid and diisobutylene having $\overline{M}$./ of 560 emulsifier: nonionic surfactant consisting of polyoxyethylene nonylphyenyl ether of HLB 10.8 ($\overline{M}$./ : 485)

(A) Rolling Test Method

Rolling mill: 100 mm in diameter × 150 mm wide; two-high rolling mill equipped with rolls made of forged steel.

Strips to be rolled: SPCC, S, D (JIS G3141); 1 mm thick × 30 mm wide

Rolling speed; 700 m/min.

(H) Supply Method of Rolling Oil

Each lubricating oil composition was mixed with water in a predetermined concentration. The mixture was sprayed onto a roll and a strip by a gear pump with a spray quantity of 3.0 l/min. (pressure: 2.5 kg/cm$^2$) and with a dispersion temperature of 60° C. while agitating the mixture at 5000 rpm by a homomixer.

Under the above conditions, the load was measured at the time of rolling with a reduction percentage of 40%, and the load per unit width was then calculated.

TABLE 7

| | Lubricating oil composition No. | Rolling load per unit width (reduction precentage: 40%) (kg/mm) |
|---|---|---|
| This Invention | 9 | 331 |
| | 10 | 338 |
| | 11 | 354 |
| | 12 | 325 |
| | 13 | 329 |
| Control | (6) | 367 |
| | (7) | 371 |

Remarks:
Concentration of dispersion: 3% by weight
Spray temperature: 60° C.

As seen from Table 7, when the compositions of the present invention are employed as rolling oils, they exhibit superior rolling performance compared with the conventional emulsion-type rolling oils containing an emulsifier. Even if a comparison is made in terms of the performance of the lubricating oil composition 9 which is based on the present invention and of the control composition (6) which contains the same lubricating oil component as the composition 9, the former composition which employs a water-soluble dispersant is better in the plating-out properties of the oil and shows superior rolling lubrication, compared with the latter composition utilizing an emulsifier.

EXAMPLE 6: STABILITY TEST OF DISPERSION AND OIL ADHESION TEST

With respect to each of the lubricating oil compositions shown in Table 6, the stability and oil adhesion tests were performed in accordance with the following methods. The test results are given in Table 8.

(a) Stability Test of Dispersion

Each lubricating oil composition was mixed with water in a predetermined concentration and agitated for five minutes by a homomixer at 5000 rpm. That the agitation speed was reduced to 500 rpm and the agitation was continued for one hour. The state of the dispersion was observed by the naked eye. The dispersion was graded using the following standard, and the average particle diameter was measured by means of a Coulter counter.

The grading was made in accordance with the following three ratings:

o: evenly dispersed phase; scarcely separated, floating substances observed in the top layer Δ: evenly dispersed phase; slightly separated, floating substances observed in the top layer x: almostly separated; oil phases or solid coagula occurred

(b) Oil Adhesion Test

Each lubricating oil composition was mixed with water in a predetermined concentration. The mixture was agitated by a homomixer at 5,000 rpm to prepare a dispersion. The adhesion test was conducted by spraying the thus prepared dispersion onto a sample piece for two seconds (pressure: 1.0 atm; sprayed amount: 1 l/min.) by a gear pump. Thereafter, the sample piece was dried at room temperature, and the amount or the oil which had adhered was measured by the weight method. The tested sample pieces were of the same type as those used in the rolling test. Each sample piece was 50 mm wide × 100 mm long. Its surface roughness was 4.0 to 5.0 μ, and the piece was deoiled with a solvent prior to the adhesion test.

TABLE 8

| Sample No. | Lubricating oil composition No. | | Concentration of dispersion (wt. %) | Grade of stability of dispersion: grade | temp. (°C.) | average particle diameter | Spray temp. (°C.) | Adhesion quantity (g/m²) |
|---|---|---|---|---|---|---|---|---|
| (xvii) | This Invention | 9 | 3 | o | [60] | (9.5) | 60 | 1.1 |
| (xviii) | | " | " | o | [40] | (10.0) | 40 | 1.1 |
| (xix) | | " | 1 | o | [60] | (11.0) | 60 | 0.6 |
| (xx) | | 10 | 3 | o | [60] | (9.0) | 60 | 1.0 |
| (xxi) | | 11 | 3 | o | [60] | (7.0) | 60 | 0.8 |
| (xxii) | | " | 10 | o | [60] | (7.0) | 60 | 2.1 |
| (xiii) | | 12 | 3 | o | [60] | (8.5) | 60 | 1.0 |
| (xiv) | | " | " | o | [20] | (9.0) | 20 | 1.1 |
| (xxv) | | 13 | 3 | o | [60] | (11.5) | 60 | 1.2 |
| (xxvi) | Control | (6) | 3 | o | [60] | (5.5) | 60 | 0.7 |
| (xxvii) | | (7) | " | o | [60] | (5.0) | 60 | 0.6 |
| (xxviii) | | (8) | " | x | [60] | (19.5) | — | — |
| (xxix) | | (9) | " | o | [60] | (4.0) | 60 | 0.6 |
| (xxx) | | (10) | " | Δ | [60] | (16.0) | — | — |

As apparent from Table 8, the lubricating oil compositions of the present invention can be stably dispersed even if the particle diameters of the oil are rather large, as coasted to the control compositions (6) and (7) which use an emulsifier. In the case of the lubricating oil compositions of this invention, so long as an agitation force is applied to a certain extent, the dispersion remains stable if the diameter of the oil particles are rare large. Therefore, the compositions of this invention allow the oil component to adhere in a large quantity and exhibit excellent lubrication performance. On the other hand, no stable system can be obtained if the dispersant is too little as in the Control xxviii. If the dispersant is added too much, the resulting dispersion shows good stability, but the oil particles become small in diameter and lose the advantages of the present invention.

EXAMPLE 7: CIRCULATION TEST OF DISPERSION AND ANNEALING TEST

To investigate the circulation stability of the dispersion containing each of the lubricating oil compositions shown in Table 6, the concentration of the dispersion was adjusted to 3% by weight, and its temperature was controlled to 60° C. (20 l of the dispersion was prepared in a tank of a capacity of 30 l and stirred by a homomixer at 500 rpm). The dispersion was sprayed by a gear pump through a spray nozzle (pressure: 2.5 atm; oil supply: 3.0 l) onto an iron plate which had been heated to 150° C. The dispersion was continuously circulated for 48 hours. Then, the oil fraction other than the top, floating substances in the dispersion was extracted and weighed. The weight loss was indicated by percentage with respect to the weight of the initially charged oil. In this test, in order to investigate the influence of any oily contaminant on the rolling oil, a used and discarded rolling oil of a mineral type (S.V.=15, iron powder content: 3,000 ppm) was added dropwise over 48 hours to each sample oil in an amount of 10% by weight of the sample oil.

For conducting the annealing test, the thus prepared dispersion was coated onto two steel plates using the same method as in Example 6. After being dried, the plates were superimposed one on the other and annealed (temperature: 700° C.; in a gaseous atmosphere of $N_2$ and 5% $H_2$; for two hours). The dirtiness of the surfaces of the plates was observed with the naked eye. For the sake of reference, a similar test was also conducted for a fresh oil of each of the sample oils. The grading of the annealing test was made by assigning integer "1" to the dirtiness of the fresh oil and integer "5" to the dirtiness of the used and discarded rolling oil, thereby dividing the degrees of dirtiness into five grades.

The results are shown in Table 9.

TABLE 9

| | Lubricating oil composition | Percentage of oil loss (with respect to initially charged oil weight) (%) | Grade of annealing test | |
|---|---|---|---|---|
| | | | fresh oil | after 48 hrs. |
| This Invention | 9 | 24 | 1 | 1 |
| | 10 | 21 | 1 | 1 |
| | 11 | 18 | 1 | 2 |
| | 12 | 20 | 1 | 1 |
| | 13 | 28 | 1 | 1 |
| Control | (6) | 36 | 1 | 3 |
| | (7) | 39 | 1 | 4 |
| | (9) | 16 | 1 | 3 |

When a rolling oil is circulated, such as fine metallic powders, tramp oil and decomposed oil are liable to mix into the rolling oil. Thus, the emulsion system of the rolling oil is so rendered unbalanced and unstable as to cause the oil component to separate and float into the top layer of the emulsion. Through the annealing treatment, such contaminants result in the formation of dirty spots on the surface of the annealed product.

However, from the results shown in Table 9, it will be appreciated that such contaminants are not so much absorbed in the lubricating oil compositions of the present invention as in the control lubricating oil compositions (the wasted oil floats into the top layer and fine metallic powders and like substances precipitate). It will also be appreciated that the lubricating oil compositions of the present invention show a smaller loss of the oil and form almost no dirty spots in the annealing test.

On the other hand, the conventional emulsion-type rolling oils (6) and (7) develop the oil separation described above which results in a large oil loss. Because such contaminants are taken into the rolling oils (6) and (7), a great many dirty spots have been observed in the annealing test.

EXAMPLE 8: WASTE WATER TREATMENT TEST

To 1,000 ml of each of the sample solutions prepared in accordance with the same method as in the oil adhesion test, 3 g of alumina sulfate was added, and the mixture was stirred for two minutes. Calcium hydroxide was then added to adjust the pH of the mixture to 7. After being stirred for 10 minutes, the mixture solution was allowed to stand for 30 minutes. The subnatant liquid was collected, and its COD was measured by the potassium permanganate method. The results are shown in Table 10.

TABLE 10

| | Sample No. | Analysis method COD (by the potassium permanganate method) (ppm) |
|---|---|---|
| This Invention | (xvii) | 48 |
| | (xx) | 50 |
| | (xxi) | 72 |
| | (xxiii) | 45 |
| | (xxv) | 42 |
| Control | (xxvi) | 490 |
| | (xxvii) | 570 |

As apparent from the results shown in Table 10, the compositions of this invention are generally superior in the easiness of a waste water treatment compared with the emulsions employing an emulsifier and represented by the control compositions (xxvi) and (xxvii).

What is claimed as new and intended to be secured by letters patent is:

1. A method of applying a lubricating oil composition, comprising: dispersing in water a lubricating oil component containing as essential ingredients 10 to 100% by weight of a substance of a mixture of at least two substances having a melting point of 20° to 100° C. and selected from the group consisting of an oil, fat, and a wax and from 0.5 to 20 weight % based on the amount of said lubricating oil component, of at least one water-soluble, anionic polymeric dispersant having a molecular weight of 250 to 25,000 as the sole dispersant having a molecular weight of 250 to 25,000 as the sole dispersant and selected from the group consisting of an olefin-maleic acid copolymer salt, an acrylic acid or a methacrylic-maleic acid copolymer salt, a homopolymer salt of acrylic acid or methacrylic acid, and a copolymer salt of acrylic acid and methacrylic acid, at a temperature of or lower than the melting point of said lubricating oil component, whereby a dispersion is prepared; and then applying said dispersion onto a machine portion undergoing plastic working at a temperature of at least the melting point of said lubricating oil component.

2. The method according to claim 1, wherein said suspension is applied to a machine portion which has been heated up to a temperature of at least the melting point of the lubricating oil component.

3. The method according to claim 1, wherein said dispersion has a solids content of 0.1 to 40% by weight.

* * * * *

UNITED STATES PATENT AND TRADEMARK OFFICE

CERTIFICATE OF CORRECTION

PATENT NO. : 5,094,764

DATED : March 10, 1992

INVENTOR(S) : Hiroshi Kuwamoto et al.

It is certified that error appears in the above-identified patent and that said Letters Patent is hereby corrected as shown below:

On the title page, please include, --item [30]: Foreign Priority Data:

should be, --May 8, 1979 [JP] Japan.....54-55890

March 10, 1980 [JP] Japan.....55-30155--.

Signed and Sealed this

Eighth Day of June, 1993

*Attest:*

Michael K. Kirk

MICHAEL K. KIRK

*Attesting Officer*

*Acting Commissioner of Patents and Trademarks*